US009330553B2

(12) United States Patent
Lyles

(10) Patent No.: US 9,330,553 B2
(45) Date of Patent: May 3, 2016

(54) ENTERTAINMENT AND SECURITY MONITORING APPARATUS

(71) Applicant: Nichele D. Lyles, Merrillville, IN (US)

(72) Inventor: Nichele D. Lyles, Merrillville, IN (US)

( * ) Notice: Subject to any disclaimer, the term of this patent is extended or adjusted under 35 U.S.C. 154(b) by 44 days.

(21) Appl. No.: 14/468,506

(22) Filed: Aug. 26, 2014

(65) Prior Publication Data

US 2016/0063835 A1 Mar. 3, 2016

(51) Int. Cl.

| | |
|---|---|
| ***G08B 23/00*** | (2006.01) |
| ***G08B 21/02*** | (2006.01) |
| ***H04R 3/00*** | (2006.01) |

(52) U.S. Cl.

CPC ..... *G08B 21/0202* (2013.01); *G08B 21/0291* (2013.01); *H04R 3/00* (2013.01)

(58) Field of Classification Search

CPC ..... G08B 21/0202; G08B 21/0291; G08B 21/02; G08B 25/016; G08B 21/0288; G08B 21/18; G08B 21/24; G08B 21/0446; G08B 21/0453; G08B 25/009; G08B 23/00; G08B 21/0286; H04R 3/00; A61B 5/0022; A61B 2505/07; A61B 2562/0257; A61B 5/02438

USPC ..... 340/573.1, 686.1, 666, 539.11–539.23, 340/575, 693.5, 573.4, 286.07; 434/128; 600/529, 538

See application file for complete search history.

(56) References Cited

U.S. PATENT DOCUMENTS

| | | | | |
|---|---|---|---|---|
| 5,081,722 | A | 1/1992 | Yu | |
| 5,446,934 | A | 9/1995 | Frazier | |
| 5,646,593 | A * | 7/1997 | Hughes | G08B 1/0222 340/539.1 |
| 6,746,299 | B1 | 6/2004 | Graf | |
| 7,425,901 | B2 | 9/2008 | Groover | |
| 2008/0024311 | A1 * | 1/2008 | Mann | A61B 5/11 340/573.1 |
| 2008/0113319 | A1 * | 5/2008 | Davis | G09B 7/00 434/128 |
| 2010/0060448 | A1 | 3/2010 | Larsen et al. | |
| 2011/0032103 | A1 * | 2/2011 | Bhat | G08B 13/196 340/573.1 |

* cited by examiner

*Primary Examiner* — Anh V La
(74) *Attorney, Agent, or Firm* — Dale J. Ream

(57) ABSTRACT

An entertainment and monitoring apparatus for use in monitoring the safety of an infant includes a housing having opposed ends, the housing having an arcuate configuration between opposed ends. The ends define openings in communication with an interior area. First and second extension members are movable through respective ends between retracted configurations substantially inside the housing and extended configurations substantially outside of and extending away from the openings. First and second guard members are coupled to distal ends of respective extension members, the guard members having free ends displaced from one another at respective retracted configurations and adjacent one another at respective extended configurations. A proximity sensor is positioned on the first guard member and configured to detect movement between respective free ends of first and second guard members. A first speaker is electrically connected to the proximity sensor and actuated when movement is detected.

16 Claims, 11 Drawing Sheets

ENTERTAINMENT AND SECURITY MONITORING APPARATUS

BACKGROUND OF THE INVENTION

This invention relates generally to infant and baby products and, more particularly, to an apparatus configured for entertaining an infant, for maintaining the safe position of the infant, and for enabling a caregiver to monitor the baby's position and well-being from a distance remote from the actual position of the baby.

The benefits and necessity of entertaining an infant are well known. Providing lights, sounds, mirrors, and play things are educational and comforting to an infant as well as an aid to a caregiver by keeping the infant's attention occupied for significant periods of time without direct involvement of the care giver. In addition, the position of an infant must be monitored at all times that he is on the floor or bed so as not to crawl, scoot, or roll into an area of danger, such as near a staircase, fireplace, or other area of danger. Still further, a caregiver often needs to monitor a baby's location and wellbeing from another room or from a distance.

Various devices have been proposed in the prior art for entertaining an infant, such as a mobile with hanging playthings, music players, and other electronic devices. Further, devices for holding or containing an infant away from a danger area are known, such as a swing, bouncy seat, or playpen. Finally, devices for conveying sounds from an area surrounding a baby to a monitoring device in another room are known. Although assumably effective for their intended use, there is no apparatus that monitors a baby's position on the floor using sensors, that associates particular sensors with particularly positioned speakers, and that is adjustably positioned to selectively surround a baby or to enable the baby freedom to move away from the apparatus.

Therefore, it would be desirable to have an apparatus for use in monitoring the position of an infant, selectively containing the infant, and entertaining the infant that overcomes the limitations of the prior products and patent proposals.

SUMMARY OF THE INVENTION

An entertainment and monitoring apparatus for use in monitoring the safety of an infant according to the present invention includes a housing having opposed ends, the housing having an arcuate configuration between opposed ends. The opposed ends define openings in communication with an interior area. First and second extension members are movable between respective retracted configurations substantially inside the housing and respective extended configurations substantially extending away from the first and the second openings.

First and second guard members are coupled to respective distal ends of respective first and the second extension members, the first and the second guard member having respective free ends displaced from one another at the respective retracted configurations and adjacent one another at the respective extended configurations. A proximity sensor is positioned on the first guard member and configured to detect movement between respective free ends of first and second guard members. A first speaker is electrically connected to the proximity sensor and actuated when movement is detected.

Therefore, a general object of this invention is to provide an apparatus for entertaining a nearby infant while monitoring the infant's position and providing alerts to a caregiver.

Another object of this invention is to provide an apparatus, as aforesaid, that partially or completely surrounds an infant and includes proximity, motion, or touch sensors to determine a position of the infant.

Still another object of this invention is to provide an apparatus, as aforesaid, having one or more speakers electrically connected to the sensors so as to provide audible indications of the detected position.

Yet another object of this invention is to provide an apparatus, as aforesaid, having a microphone and USB port for receiving audio data or audible voice streams for later playback for the infant's amusement or comfort.

A further object of this invention is to provide an apparatus, as aforesaid, having a remote monitoring device configured to receive indicators of the infant's position or audible sounds being made by the infant.

A still further object of this invention is to provide an apparatus, as aforesaid, that is easy to use, to configure, and to carry.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
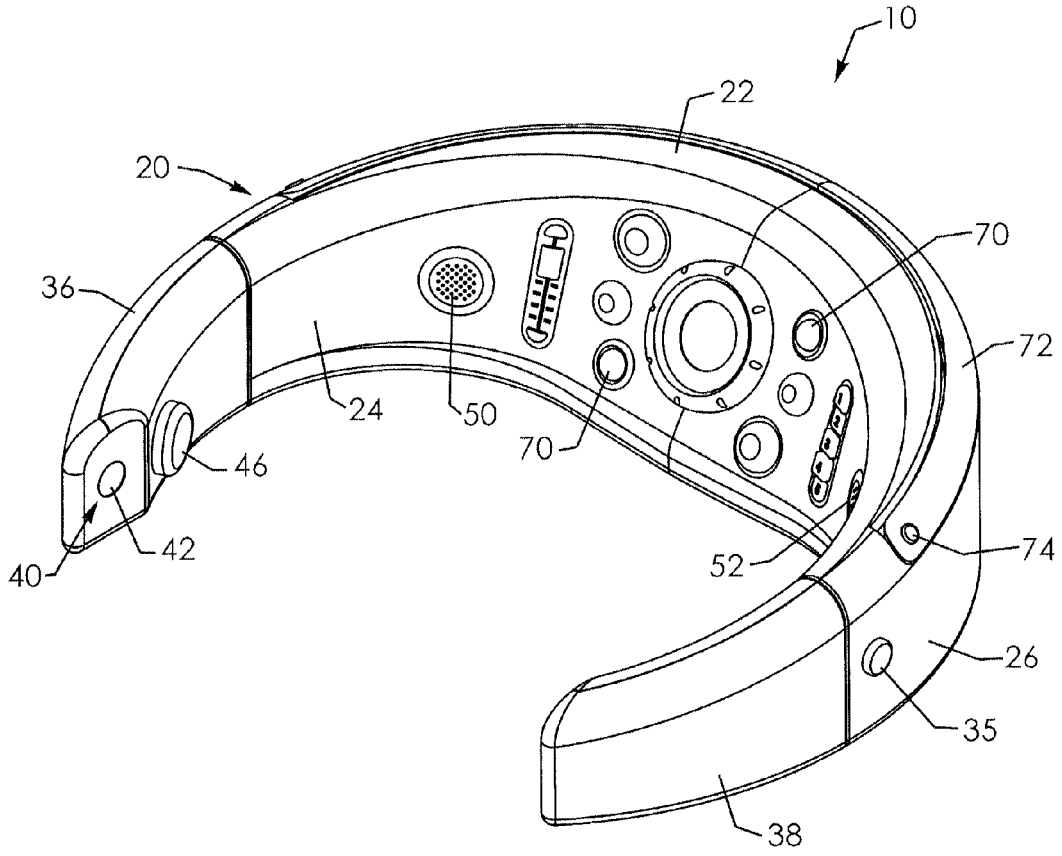
FIG. 1 is a perspective view of an entertainment and monitoring apparatus according to a preferred embodiment of the present invention illustrating the extension members at a fully retracted configuration.

An entertainment and monitoring apparatus according to the present invention will now be described in detail with reference to FIGS. 1 to 12 of the accompanying drawings. The entertainment and monitoring apparatus 10 includes a housing 20 that includes both entertainment and safety monitoring components, extensible guard members 36, 38, a proximity sensor 40, a pair of touch sensors 46, 48, and a remote monitoring device 80, a microphone 54, and speakers 50, 52.

The housing 20 includes opposed first 28 and second 30 ends. The housing 20 includes an inner wall 24 and an outer wall 26 that together define an interior area configured to contain electronic components as will be described later. The housing 20 includes a generally arcuate or arched shape configuration. In an embodiment, the housing 20 may include a generally U-shaped or hemispherical configuration (FIG. 1). A plurality of audio/visual devices 70 may be coupled to the inner wall 24 of the housing 20. The audio/visual devices 70 may include lights or sound elements and may be electrically connected to a battery 16 situated in the interior area defined by the housing 20. In some embodiments, a plurality of non-electrical ornaments or hand manipulated toys attractive to an infant may be coupled to the inner wall 24 of the housing 20.

Figure 2:
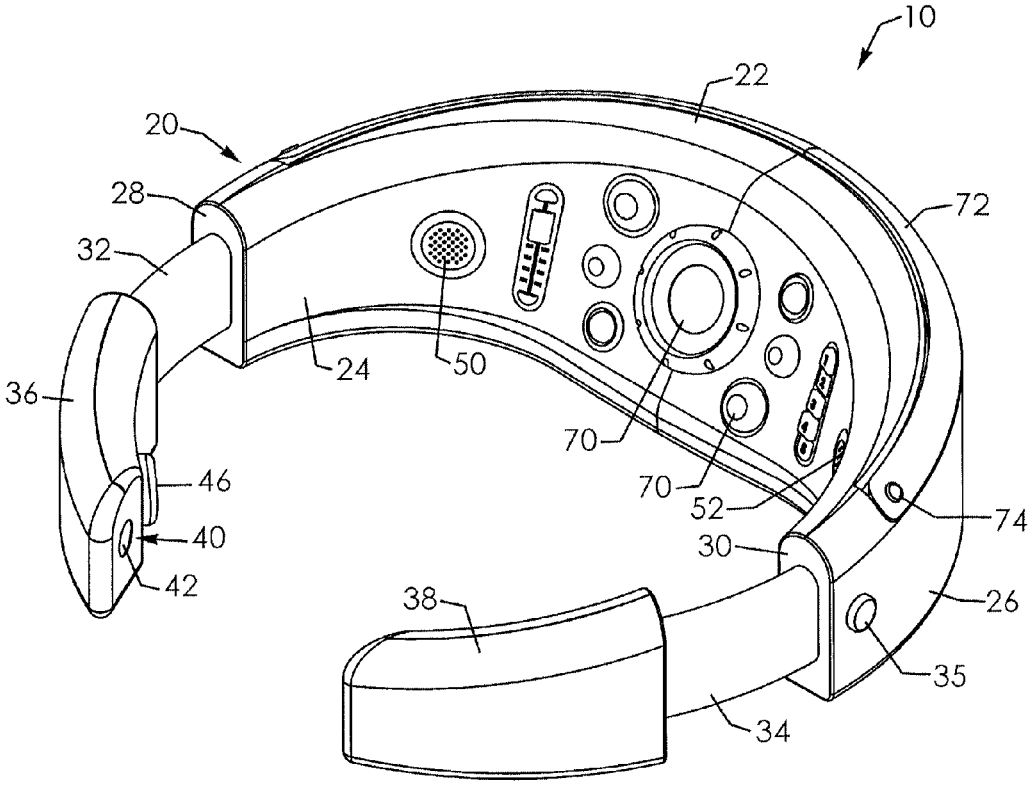
FIG. 2 is a perspective view of the apparatus as in FIG. 1 illustrating the extension members at a partially extended configuration.
Figure 3:
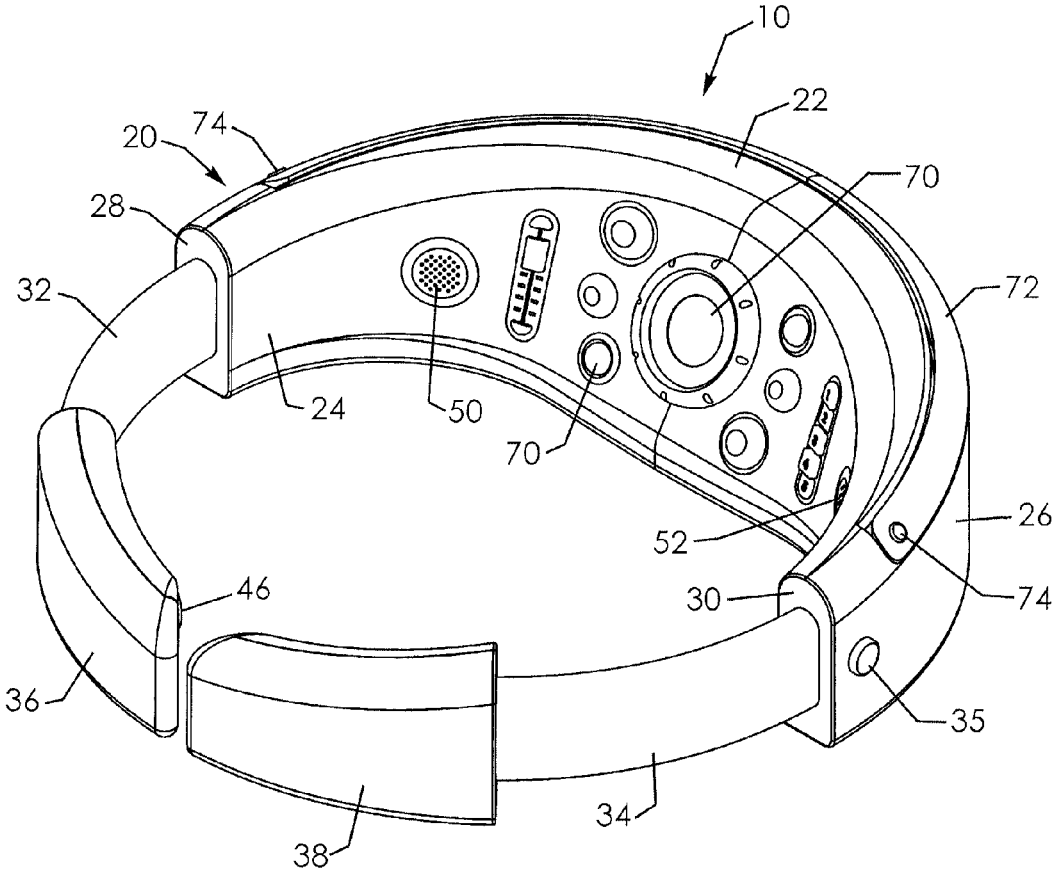
FIG. 3 is a perspective view of the apparatus as in FIG. 1 illustrating the extension members at a fully extended configuration.

Each of the first 28 and second 30 ends defines an opening or slot in communication with the interior space. The openings provide access to the interior area. The entertainment and monitoring apparatus 10 includes first 32 and second 34 extension members that are slidably movable through respective openings between retracted configurations substantially inside the interior area of the housing 20 (FIG. 1) and extended configurations substantially outside of the interior area of the housing 20 and extending away from the first 28 and second 30 ends (FIGS. 2 and 3). It is understood that the extension members 32, 34 may be manually positioned in selected intermediate (FIG. 2) or fully extended configurations (FIG. 3). It is understood that each extension member 32, 34 includes a shape configuration that is gently curved and complementary to the curvature of the housing 20 into which it retracts (FIG. 3). An extension member release button 35 may be situated on the housing 20 and be operatively coupled to the extension members so as to selectively release them to be slidably operated or to lock them at a selected position (FIG. 2).

Each extension member includes a distal end. First 36 and second 38 guard members are coupled to respective distal ends of respective extension members 32, 34 (FIG. 3). Each guard member 36, 38 includes a curved configuration that is complementary to and continues the curvature of the extension members. Each guard member 36, 38 includes a free end opposite from the guard member's connection to a respective extension member.

Figure 5:
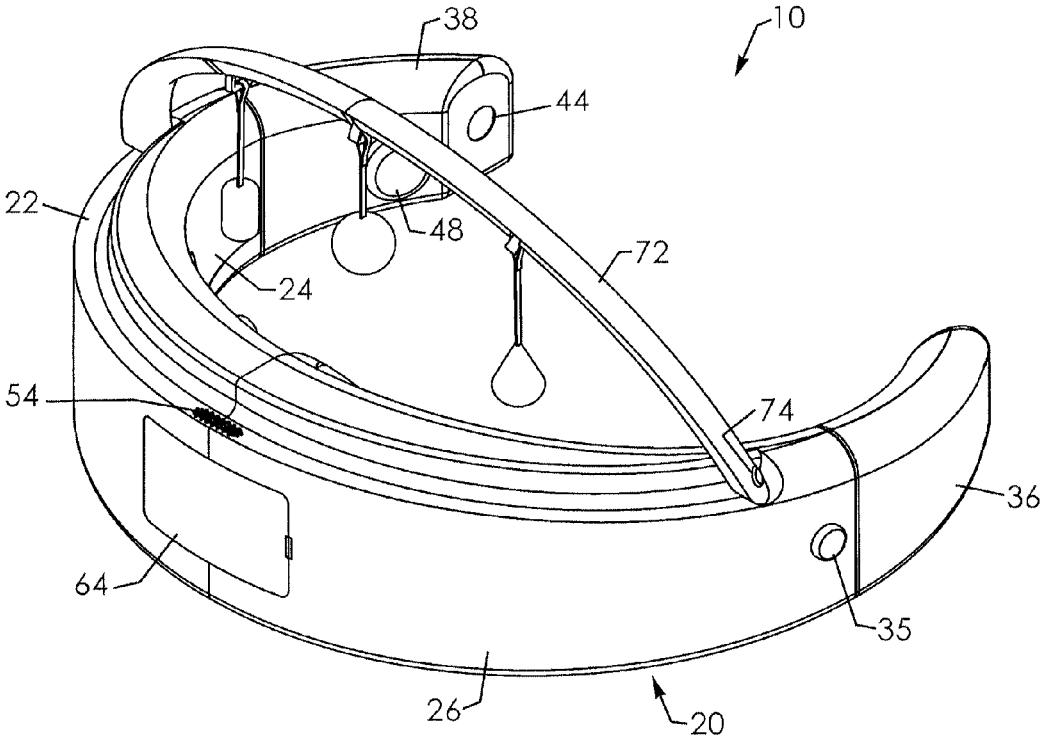
FIG. 5 is a perspective view of the apparatus as in FIG. 4 taken from a rear angle.
Figure 6:
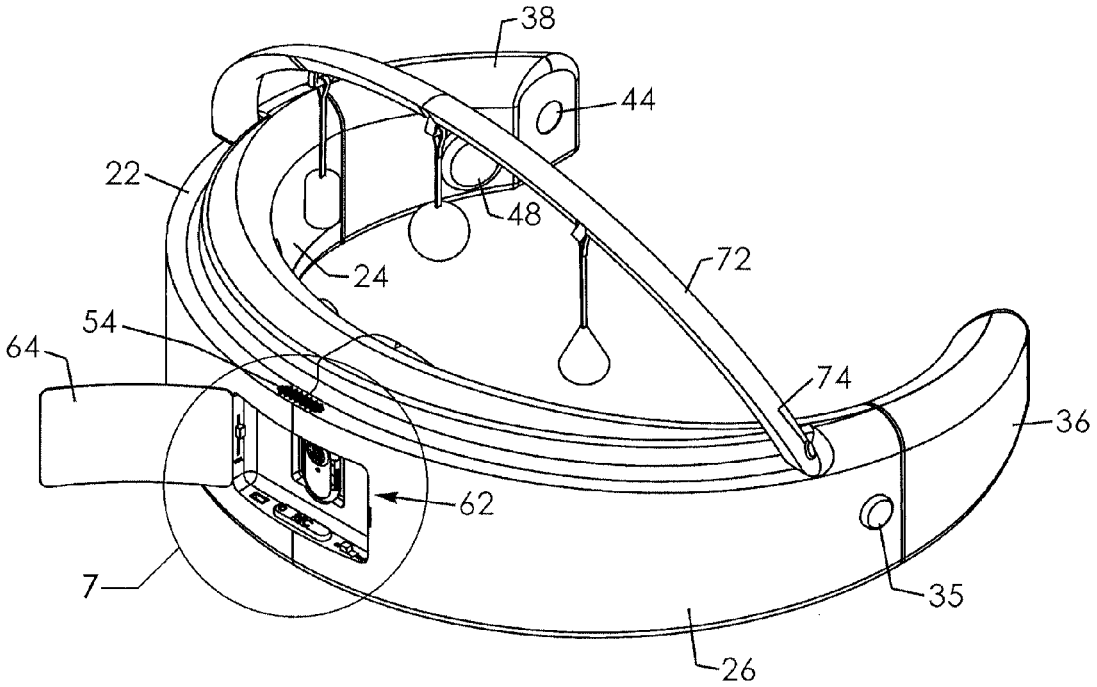
FIG. 6 is a perspective view of the apparatus as in FIG. 5 showing a compartment in an open configuration.
Figure 12:
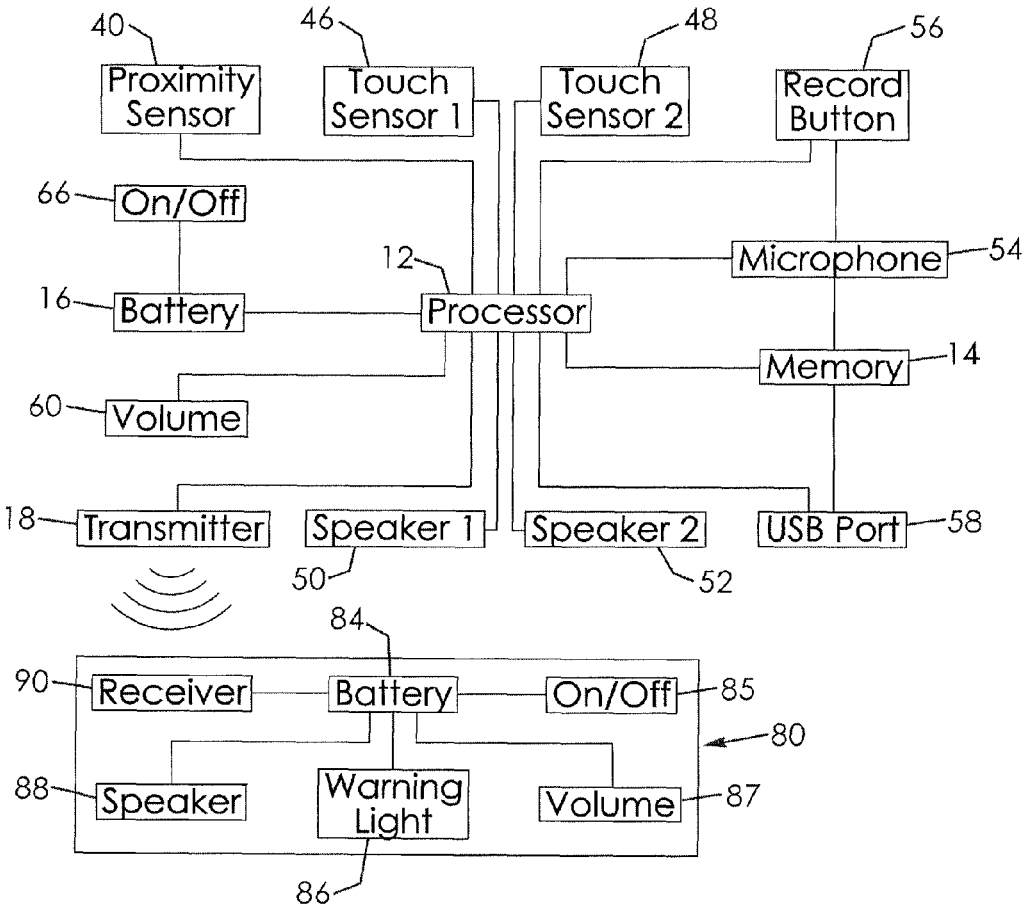
FIG. 12 is a block diagram illustrating the electronic components of the apparatus according to a preferred embodiment of the present invention.

A proximity sensor 40 may be positioned at the free end of the first guard member 36 (FIG. 2) and electrically connected to the battery 16 within the interior area of the housing 20 (FIG. 12). The proximity sensor 40 is configured to detect the presence of a nearby object without any physical contact with it. The proximity sensor 40 may emit a beam of electromagnetic radiation (i.e. infrared radiation) and then analyze changes in the return signal. Accordingly, the proximity sensor 40 may include a signal sending portion 42 situated on the free end of the first guard member 36 (FIG. 2) and a reflecting portion 44 situated on a free end of the second guard member 38 (FIG. 5). In another embodiment, a motion sensor may be utilized instead of a proximity sensor, the motion sensor being activated when movement is detected.

First 50 and second 52 speakers may be situated on the inner wall 24 of the housing 20 (FIG. 2) and electrically connected to the battery 16 (FIG. 12). The first 50 and second 52 speakers are displaced from one another and may be seen as being adjacent first 28 and second 30 ends of the housing 20 (FIG. 3). The first speaker 50 may be electrically connected to the proximity sensor 40, the proximity sensor 40 being configured to actuate the first speaker 50 when the proximity sensor 40 detects the presence of an object, such as the skin of an infant. In an embodiment, the proximity sensor 40 may detect motion or movement, such as movement of an infant into a predetermined range of the sensor. The connection between the proximity sensor 40 and first speaker 50 may be an electrical wire (not shown) extending therebetween, such as through the interior area defined by the housing 20. In an embodiment, the operative connection may be a wireless connection such as Bluetooth technology or a transmitter/receiver combination.

It is understood that the proximity sensor 40 may be configured to cause the first speaker 50 to emit a tone, another predetermined sound, or a pre-recorded voice message. In an embodiment where a predetermined or pre-recorded message is emitted, the circuitry may include a processor 12 and a memory 14 in which the memory 14 is configured to store sound data and the processor 12 causes the sound data to be delivered and emitted by the first speaker 50.

In use, the proximity sensor 40 and first speaker 50 combine in operation to notify a caregiver if a baby has crawled, rolled, or scooted into an area proximate the proximity sensor 40. When the first 32 and second 34 extension members are at respective retracted configurations as described above, respective free ends of the guard members 36, 38 may be displaced from one another (FIGS. 1 and 2) allowing a baby to move therebetween. However, when the extension members are at respective extended configurations, the free ends of respective guard members 36, 38 may be in relative close proximity (FIG. 3) substantially blocking access. Even when partially or completely displaced, the proximity sensor 40 (or motion sensor) is still capable of sensing the presence or movement of a baby within a predetermined area such that the first speaker 50 is actuated.

In another aspect of the invention, a first touch sensor 46 may be positioned on the first guard member 36 (FIG. 2) and is electrically connected to the battery 16, such as with a wire extending through the interior space of the housing 20 or in a wireless connection in the manner described above. The first touch sensor 46 may be operatively connected to the second speaker 52 in a manner similar to how the proximity sensor 40 is connected thereto. Similarly, a second touch sensor 48 may be positioned on the second guard member 38 (FIG. 2) and is electrically connected to the battery 16 and to the first speaker 50. Each touch sensor is configured to detect physical contact and to make a notification via a respective speaker as will be described below.

It is understood that respective touch sensors are positioned diagonal or in opposite directions in relation to respective speakers. More particularly, the first speaker 50 and first touch sensor 46 may be situated in the direction of the first end 28 of the housing 20 whereas the second speaker 52 and second touch sensor 48 may be situated in the direction of the second end 30 of the housing 20. In use, when a first touch sensor 46 detects contact, such as with a hand or foot of the infant, it is the second (oppositely situated) speaker 52 that is actuated to emit a tone or message, and vice versa. In this manner, the baby is influenced to move in the direction of the respective activated speaker and away from the direction of the respective touch sensor 46, 48 that was contacted. Accordingly, the infant stays generally centered within the confines of the apparatus.

In some embodiments, the memory 14 may be situated in the interior area of the housing 20. Further, a microphone 54 may be positioned in the housing 20 and accessible from a top wall 22 of the housing 20, the microphone 54 and memory 14 being in data communication. In other words, a user can speak into the microphone 54, the memory 14 being configured to store audible sound data received by the microphone 54. A user may be required to press a "Record" button 56 to activate the microphone 54 to receive audible sounds and direct them to the memory 14 for storage (FIG. 7).

The processor 12 described above may also be positioned in the interior of the housing 20 and may be in data communication with the memory 14. The processor 12 is electrically connected to and in data communication with the sensors and speakers described above. It is understood that electrical and data connections may be with wires or circuitry or a combination of both. The memory 14 may store programming for execution by the processor 12. Programming instructions stored in memory 14, when executed by the processor 12, selectively directs audio data stored in memory 14 (such as audio data received by the microphone) to the first speaker 50 or to both the first speaker 50 and second speaker 52.

Figure 7:
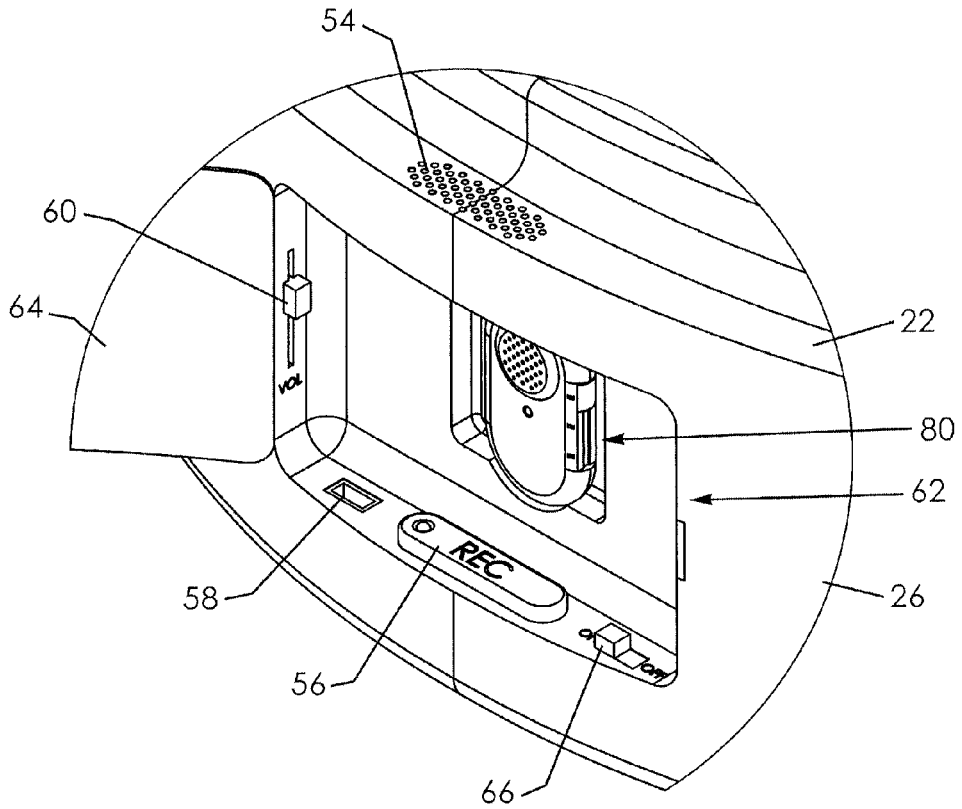
FIG. 7 is an isolated view on an enlarged scale taken from FIG. 6.

In an embodiment, the entertainment and monitoring apparatus 10 includes a USB port 58 (FIG. 7). The USB port 58 and Record button 56 may be situated in a compartment 62 accessible through a compartment door 64 on an outer wall 26 of the housing 20 although other positions for the compartment 62 would also work. A volume control 60 may also be positioned in the compartment 62 and electrically connected to the first speaker 50 and second speaker 52. Referring again to the USB port 58, the USB port 58 is in data communication with the memory 14 such that audio data uploaded from the USB port 58, such as from a memory stick or other portable memory device, may be stored in the memory 14, such as to be later directed to the speakers, such as under programming control executed by the processor 12. The apparatus 10 may include an on/off switch 66 electrically connected to the battery 16 and situated in the compartment 62 (FIG. 7). The battery 16 is configured to provide current to various electrical components described throughout this application when the on/off switch 66 is in the "on" configuration.

The entertainment and monitoring apparatus 10 may include a plurality of audio/visual devices ("A/V devices") positioned on the inner wall 24 of the housing 20. Each A/V device 70 may be electrically connected to the battery 16 in the housing 20 and configured to emit light or sound or both when energized. It is understood that some of the audio/visual devices 70 may be actuated manually, such as by an infant touching it, while others may light up or emit sound automatically when the on/off switch 66 is in the "on" configuration. In an embodiment, control of the audio/visual devices 70 may be controlled by the processor 12 executing programming.

Figure 4:
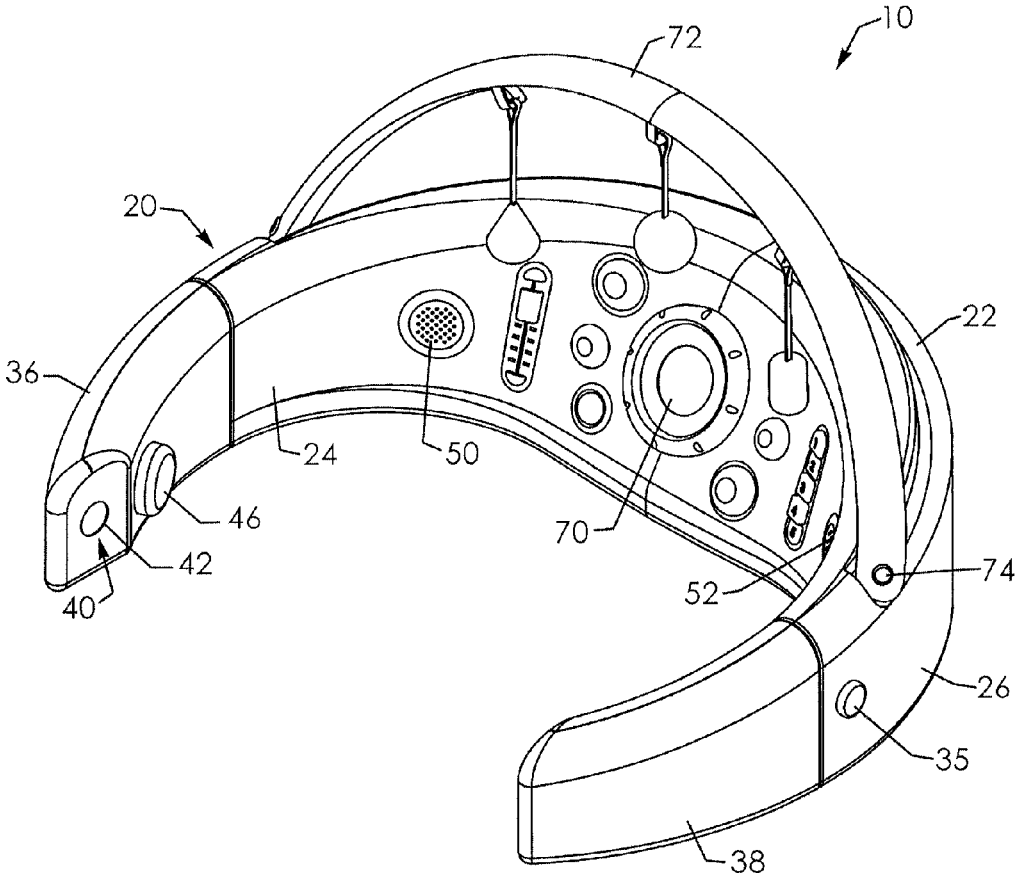
FIG. 4 is a perspective view of the apparatus as in FIG. 1 illustrating a mobile support member at a deployed configuration.

The entertainment and monitoring apparatus 10 may include a mobile support member 72 pivotally coupled at opposed ends to the housing 20. The mobile support member 72 includes an elongate configuration having a generally arched configuration. The mobile support member 72 is pivotally movable between a stowed configuration adjacent the housing 20 (FIG. 2) and a deployed configuration extending upwardly away from and above the housing 20 (FIGS. 4 and 5). It is understood that additional play things may hang from the mobile support member 72 in the manner of a mobile or may be used as a handle for carrying the entertainment and monitoring apparatus 10. The mobile support member 72 may include a support member release button 74 configured to lock or release the mobile support member 72 to move as described above (FIG. 4).

Figure 8:
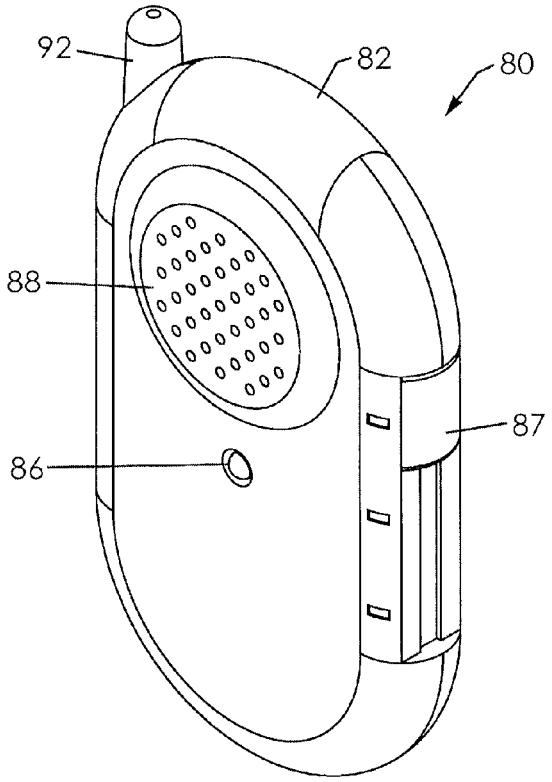
FIG. 8 is a perspective view of a remote monitoring device removed from the compartment of FIG. 7.
Figure 9:
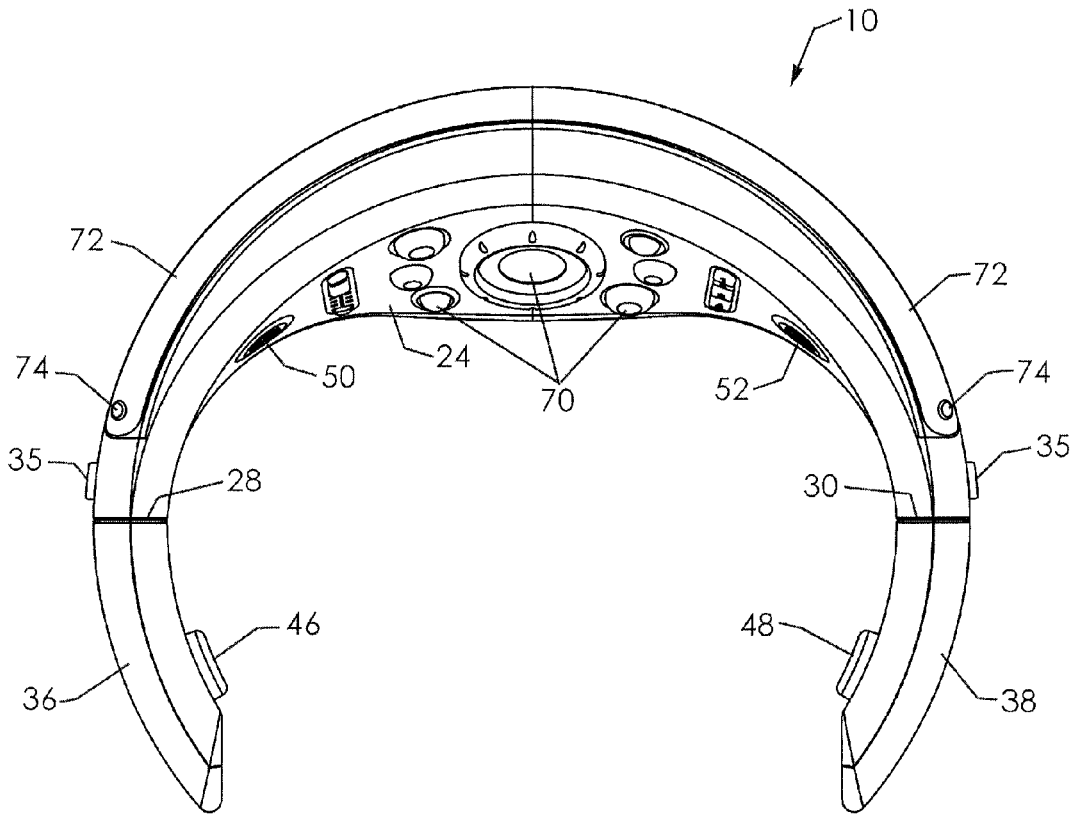
FIG. 9 is a top view of the apparatus as in FIG. 1.
Figure 10:
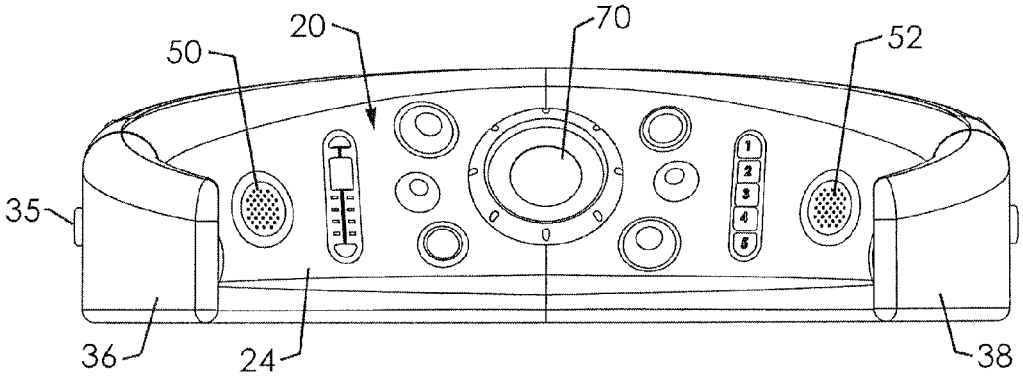
FIG. 10 is a front view of the apparatus as in FIG. 9.
Figure 11:
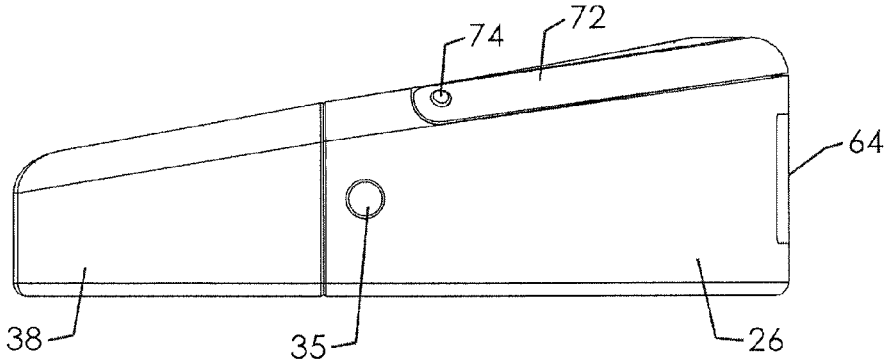
FIG. 11 is a side view of the apparatus as in FIG. 10.

In another aspect, the entertainment and monitoring apparatus 10 may include remote monitoring device 80 having a remote device housing 82 that defines an interior space in which to hold electronic components (FIG. 8). The remote device housing 82 may be stored in the compartment 62 of the housing 20 when not in use (FIG. 7). A remote device battery 84 may be situated in the interior space of the remote device housing 82 and be electrically connected to a power indicator light 86. In an embodiment, the power indicator light 86 may be configured to be energized when a touch sensor or proximity sensor (described above) has been actuated. In this embodiment, the light 86 may be referred to as a warning light (FIG. 12). The remote monitoring device 80 may have an on/off switch 85 and a volume adjustment control 87. A remote device speaker 88 is also situated in the interior space of the remote device housing 82 and in electrical communication with the remote device battery 84.

A receiver 90 is situated in the interior space of the remote device housing 82 and is in electrical communication with the remote device speaker 88, the receiver 90 being configured to receive a signal indicative of an audio stream and to deliver the audio stream to the remote device speaker 88. An antenna 92 may be coupled to the remote device housing 82 and electrically connected to the receiver 90 and configured to enhance signal receipt by the receiver 90.

The remote monitoring means includes a transmitter 18 situated in the housing 20 that is in electrical communication with the microphone 54 described previously and with the battery 16. The transmitter 18 is configured to emit a signal indicative of an audio stream received by the microphone 54. It is this transmitted signal that is referred to above as being received by the receiver 90 in the remote device housing 82 and that is then broadcast by the remote device speaker 88. Simply put, a caregiver in proximity to the remote device housing 82 is able to monitor the sounds of an infant positioned near the main housing 20. It is understood that the processor 12 executing programming steps in memory 14 may control when an audio stream received by the microphone 54 is either stored in memory 14 for later playback or immediately transmitted by the transmitter 18. Specifically, operation of the Record button 56 may determine the appropriate action.

Accordingly, the entertainment and monitoring apparatus 10 described above enables a caregiver to both entertain and monitor the position and safety of an infant. It is understood that while certain forms of this invention have been illustrated and described, it is not limited thereto except insofar as such limitations are included in the following claims and allowable functional equivalents thereof.

The invention claimed is:

1. An entertainment and monitoring apparatus for use in monitoring the safety of an infant in proximity therewith, comprising:

a housing having opposed first and second ends and defining an interior area, said housing having an arcuate configuration between said first and said second ends;

wherein said first and second ends define first and second openings, respectively, in communication with said interior area of said housing;

first and second extension members movable between respective retracted configurations substantially inside said housing and respective extended configurations substantially extending away from said first and said second openings;

first and second guard members coupled to respective distal ends of respective first and said second extension members, said first and said second guard member having respective free ends displaced from one another at said respective retracted configurations and adjacent one another at said respective extended configurations;

a proximity sensor positioned on said first guard member and configured to detect movement between respective free ends of said first guard member and said second guard member; and a first speaker associated with said housing, said proximity sensor being in electrical communication with said speaker and configured to actuate said speaker when movement is detected.

2. The entertainment and monitoring apparatus as in claim 1, comprising:

a first touch sensor positioned on an interior wall of said first guard member and configured to detect physical contact with the infant;

a second speaker associated with said housing and displaced from said first speaker; and a second touch sensor positioned on an interior wall of said second guard member and configured to detect physical contact with the infant.

3. The entertainment and monitoring apparatus as in claim 2, wherein:

said first touch sensor is in electrical communication with said second speaker and configured to actuate said second speaker when physical contact is detected;

said second touch sensor is in electrical communication with said first speaker and configured to actuate said first speaker when physical contact is detected.

4. The entertainment and monitoring apparatus as in claim 3, wherein:

said first touch sensor and said first speaker are positioned on a side of said housing associated with said first end of said housing; and said second touch sensor and said second speaker are positioned on a side of said housing associated with said second end of said housing.

5. The entertainment and monitoring apparatus as in claim 1, comprising:

a memory situated in said interior area of said housing; and a microphone situated on said housing and in data communication with said memory, said microphone configured to receive audio data and to direct said received audio data to said memory;

wherein said memory is configured to store said received audio data.

6. The entertainment and monitoring apparatus as in claim 5, comprising:

a processor electrically connected to said memory and to said first speaker; and programming in said memory that, when executed by said processor, directs said stored audio data to said first speaker.

7. The entertainment and monitoring apparatus as in claim 1, comprising:

a memory situated in said interior area of said housing;

a USB port associated with said housing, said USB port configured to receive digital data and to direct said received digital data to said memory; and wherein said memory is configured to store said received data.

8. The entertainment and monitoring apparatus as in claim 7, comprising:

a processor electrically connected to said memory and to said first speaker; and programming in said memory that, when executed by said processor, directs said stored digital data to said first speaker.

9. The entertainment and monitoring apparatus as in claim 5, comprising:

a USB port associated with said housing, said USB port configured to receive digital data and to direct said received digital data to said memory; and wherein said memory is configured to store said received audio data;

programming in said memory that, when executed by said processor, directs said stored digital data to said first speaker.

10. The entertainment and monitoring apparatus as in claim 9, comprising a plurality of audio/visual devices situated on an inner wall of said housing and electrically connected to a battery, said plurality of audio/visual devices being selectively energized to emit sound or light output.

11. The entertainment and monitoring apparatus as in claim 9, comprising an a mobile support member pivotally coupled to said housing, said mobile support member having an arched configuration and selectively movable between a stowed configuration adjacent said housing and a deployed configuration extending upwardly away from said housing.

12. The entertainment and monitoring apparatus as in claim 1, comprising remote monitoring device having:

a remote device housing defining an interior space;

a remote device battery situated in said interior space of said remote device housing;

a remote device speaker situated in said interior space of said remote device housing and in communication with said remote device battery; and a receiver positioned in interior space of said remote device housing and in operative communication with said remote device speaker, said receiver configured to receive a signal indicative of an audio stream and to selectively deliver said signal to said remote device speaker.

13. The entertainment and monitoring apparatus as in claim 12, comprising:

a battery situated in said interior area of said housing;

a microphone situated in said interior area of said housing and configured to receive an audio stream;

a transmitter situated in said housing and electrically connected to said processor and to said microphone, said transmitter configured to emit a signal indicative of said received audio stream.

14. The entertainment and monitoring apparatus as in claim 13, comprising:

a processor situated in said interior area of said housing;

a memory situated in said interior area of said housing having programming configured to be executed by said processor; and programming in said memory that when executed by said processor causes said processor to determine if said proximity sensor has detected movement and, if so, to actuate said transmitter to emit a signal indicative of movement of the infant proximate said first guard member;

wherein said remote monitoring device includes a warning light electrically connected to said remote device battery and to said receiver indicative of an alert condition; and wherein said receiver is configured to receive a signal indicative of movement of the infant proximate said first guard member and, as a result, to selectively energize said warning light.

15. The entertainment and monitoring apparatus as in claim 14, comprising programming in said memory that when executed by said processor causes said processor to determine if said first touch sensor has detected physical contact of a first touch sensor.

16. The entertainment and monitoring apparatus as in claim 14, comprising:

the processor situated in said interior area of said housing;

the memory situated in said interior area of said housing having programming configured to be executed by said processor; and programming in said memory that when executed by said processor causes said processor to determine if a first touch sensor has detected physical contact of said first touch sensor;

wherein said receiver is configured to receive a signal indicative of physical contact with said first guard member and, if detected, to selectively energize said warning light.

* * * * *